United States Patent [19]

Heath

[11] 3,937,202

[45] Feb. 10, 1976

[54] ECONOMY DRIVING AID

[75] Inventor: Donald P. Heath, Union, N.J.

[73] Assignee: Mobil Oil Corporation, New York, N.Y.

[22] Filed: Jan. 21, 1974

[21] Appl. No.: 435,403

[52] U.S. Cl. ..... 123/198 R; 73/115

[51] Int. Cl.[2] ..... F02B 33/00

[58] Field of Search..... 123/198 R; 73/115, 116

[56] References Cited

UNITED STATES PATENTS

| | | | |
|---|---|---|---|
| 2,362,446 | 11/1944 | Bodine | 73/115 |
| 2,661,713 | 12/1953 | Worel | 73/115 |
| 3,780,587 | 12/1973 | Rivere | 73/115 |
| 3,794,006 | 2/1974 | Woodward | 73/115 |

*Primary Examiner*—Charles J. Myhre
*Assistant Examiner*—Daniel J. O'Connor
*Attorney, Agent, or Firm*—Charles A. Huggett; Michael G. Gilman; Charles A. Malone

[57] ABSTRACT

An internal combustion engine operating aid which produces a signal to the engine operator when the engine throttle is depressed or released so rapidly as to reduce engine operating economy. Such a signal is produced responsive to the actuation of a diaphram or piston contained within a chamber. Each side of the diaphram or piston is connected to the engine inlet manifold, however the connecting path to one side contains a restriction orifice. Thus the pressure on the side of the diaphram or piston having no restriction orfice changes immediately upon a change of pressure in the inlet manifold, such an inlet manifold pressure change being characteristic of uneconomical rapid acceleration or deceleration, while the pressure on that side having a restriction orifice in the connective path between it and the inlet manifold changes more slowly due to the restriction, this pressure differential producing movement of the diaphram or piston and a signal to the engine operator responsive to such movement.

16 Claims, 3 Drawing Figures

RED
YELLOW
GREEN
S
P

ECONOMY DRIVING AID

BACKGROUND OF THE INVENTION

1. Field of the Invention

This invention deals with a method and apparatus for the improvement of operation of an automobile internal combustion engine, thereby resulting in improved driving economy and gasoline mileage.

2. Description of the Prior Art

With the present energy shortage, the government is emphasizing reduction in gasoline consumption to conserve energy. Incentives for lower gasoline consumption are expected to continue for many years. Thus there is now, and will continue to be, great public and national interest in means of obtaining the maximum in fuel economy from automobiles and other vehicles employing internal combustion engines.

For a period of several years, Mobil Oil Corporation sponsored an annual Mobil Economy Run, which is a lengthy test of the fuel economy of various automobiles under a wide variety of road and operating conditions. Experience in the Mobil Economy run has shown that certain driving techniques maximize fuel economy. Use of these techniques has been shown to increase fuel economy by 20 to 30% in city driving. Somewhat smaller gains would be expected in highway driving.

The experience obtained by skilled drivers in the Mobil Economy run indicates that for best fuel economy, a car should be operated at nearly constant speed in the range of 30 to 50 mph. Rapid accelerations or decelerations and operation at (or near) full throttle should be avoided. To practice for economy runs, skilled drivers used special instrumentation to determine the operating conditions for best fuel economy. This instrumentation usually included a vacuum gauge to indicate intake manifold vacuum, a special odometer to measure distance traveled to hundredths of a mile, and a burette to measure gasoline usage. However, instrumentation of this type is extremely complex for the normal driver and is additionally quite expensive.

It is an objective of this invention to provide a signal to the operator of a variable speed, variable power internal combustion engine when the engine is being accelerated or decelerated too fast, in addition to a signal when the engine is being operated at too high or too low a power output.

It is an object of this invention to provide a signal to the operator of an internal combustion engine when the engine is operating properly and most economically.

It is an object of this invention to provide to an operator of an internal combustion engine signals as to the engine's performance which are easily understood, the system providing such signals being relatively inexpensive and easily installed and maintained.

Other additional objects of this invention will become apparent upon a study of the entire specification, including the drawing and claims.

SUMMARY OF THE INVENTION

An internal combustion engine operating aid which produces a signal to the engine operator when the engine throttle is depressed or released so rapidly as to reduce engine operating economy. Such a signal is produced responsive to the actuation of a diaphram or piston contained within a chamber. Each side of the diaphram or piston is connected to the engine inlet manifold, however the connective path to one side contains a restriction orfice. Thus the pressure on the side of the diaphram or piston having no restriction orfice, changes immediately upon a change of pressure in the inlet manifold, such an inlet manifold pressure change being characteristic of uneconomical rapid acceleration or deceleration, while the pressure on that side having a restriction orfice in the connective path between it and the inlet manifold changes more slowly due to the restriction, this pressure differential producing movement of the diaphram or piston and a signal to the engine operator responsive to such movement.

DETAILED DESCRIPTION OF PREFERRED EMBODIMENT

Figures 1, 1A, 1B:
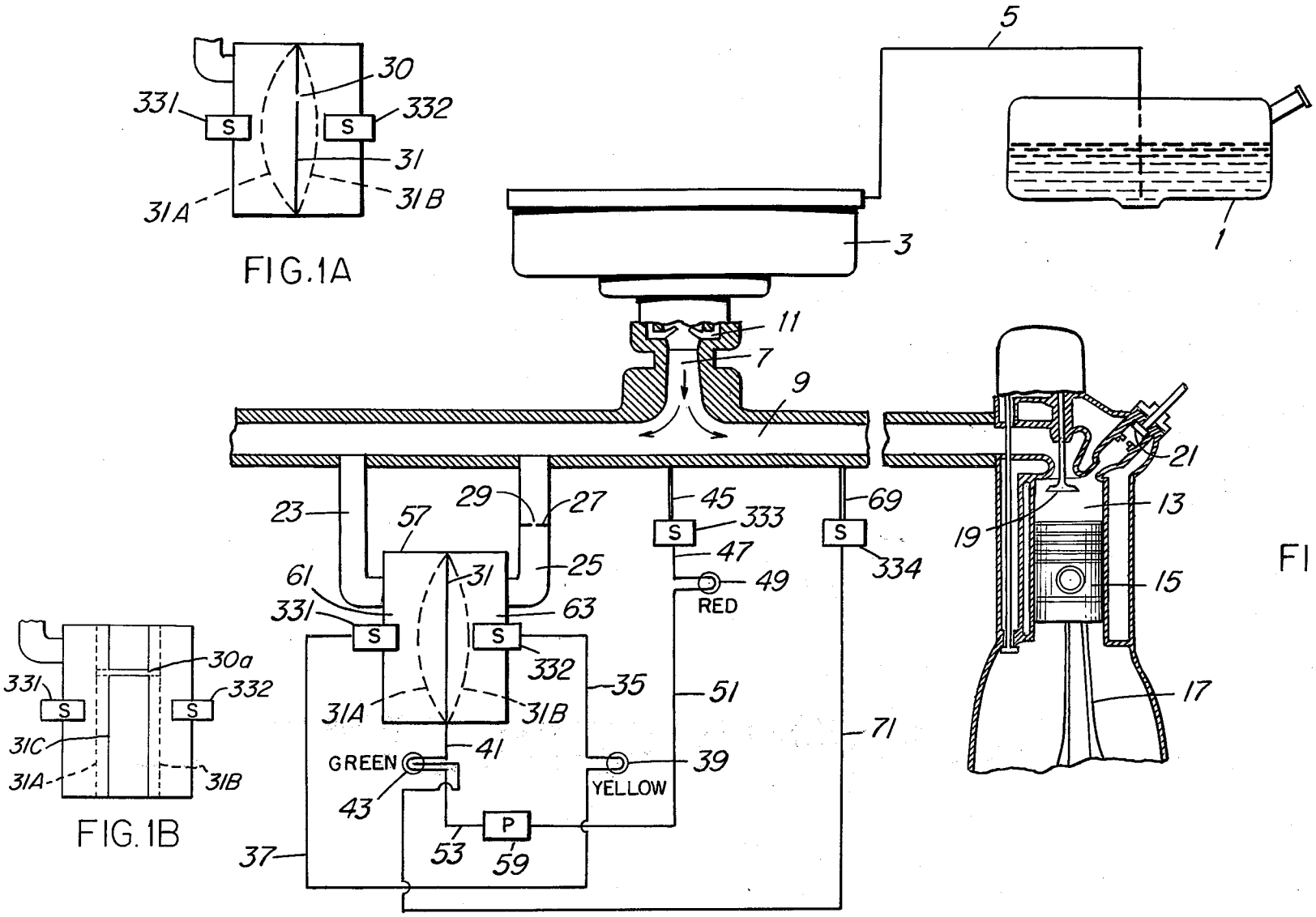
FIG. 1 is a schematic drawing illustrating an internal combustion engine system modified in accordance with an embodiment of this invention.
FIG. 1A is a detail of FIG. 1 illustrating an alternative embodiment of this invention.
FIG. 1B is a detail of FIG. 1 illustrating another alternative embodiment of this invention.

Referring to the modifed internal engine system shown in FIG. 1, a hydrocarbon fuel is stored in a main storage tank 1 and conveyed to a carburetion means 3 via a line 5. The carburetion means 3 mixes the hydrocarbon fuel with air entering from the entrance 7. The incoming air decreases the pressure at carburetion nozzle 11 thereby vaporizing and mixing with the fuel contained in the carburetion nozzle.

This air-fuel mixture now enters an inlet manifold 9 and subsequently passes into an internal combustion cylinder 13 through an inlet valve 19. The cylinder contains a piston 15 and a connecting rod 17 through which power is translated when the air fuel mixture is burned. Exhaust gases produced by this burning exit the cylinder through an exhaust valve 21.

Lines 23 and 25 connect the inlet manifold 9 with a chamber 57 containing a moveable diaphram 31. The diaphram 31 dividing or partitioning the chamber 57 into two sections 61 and 63. Line 25 which connects the inlet manifold 9 with the section 63 of chamber 57 contains a restriction orfice or plate 27 having a small opening or bleed 29 thereby restricting the flow through the line 25. Line 23 connecting the inlet manifold 9 with the section 61 of chamber 57 contains no such restriction.

Rapid acceleration produces an abrupt decrease in the vacuum of the inlet manifold. Such a vacuum decrease is immediately transmitted to section 61 via the line 23. This vacuum decrease is only gradually transmitted to section 63 through line 25 due to the restriction orfice 27. Therefore, initially after a rapid acceleration, the pressure in the section 61 is greater than in section 63 and this pressure differential moves the diaphram into the position 31B thereby activating a pressure switch 332 which allows for the passage of current from a power source 59 (in a preferred embodiment this power source is a battery) to a yellow signal light 39. As the pressures in sections 61 and 63 gradually equilibrate, the diaphram 31 returns to its previous neutral position, thereby deactivating the pressure switch 332 and the yellow signla light 39 and activating the green light 43. An inlet manifold 9 vacuum decrease of about 2.0 to 10.0 inches of mercury (and in a more preferred embodiment about 2.0 to 5.0 inches of mercury) within a time of about 1.0 seconds is required to produce a pressure differential between the sections 61 and 63 such as to move the diaphram 31 into the position 31B thereby activating the pressure switch 332 and the yellow light 39.

When driving at optimum efficiency and economy, there are no sudden changes in the inlet manifold pressure and the green light 43 remains on.

Rapid deceleration produces an abrupt increase in the vacuum of the inlet manifold. Such a vacuum increase is immediately transmitted to section 61 via the line 23. The vacuum increase is only gradually transmitted to section 63 through line 25 due to the restriction orfice 27. Therefore, initially after a rapid deceleration, the pressure in the section 61 is lower than in section 63 and this power differential moves the diaphram into the position 31A thereby activating a pressure switch 331 which allows for the passage of current from a power source 59 (in a preferred embodiment this power source is a battery) to a yellow signal light 39. As the pressures in sections 61 and 63 gradually equilibrate, the diaphram 31 returns to its previous neutral position, thereby deactivating the pressure switch 331 and the yellow signal light 39 and activating the green light 43. An inlet manifold 9 pressure increase of about 2.0 to 10.0 inches of mercury (and in a more preferred embodiment about 2.0 to 5.0 inches of mercury) within a time of about 1.0 seconds is required to produce a pressure differential between the sections 61 and 63 such as to move the diaphram 31 into the position 31A thereby activating the pressure switch 331 and the yellow light 39.

In a more preferred embodiment, the flow of gases form the inlet manifold 9 is restricted by deleting the connecting line 25 containing the restriction orfice 27 having a small opening 29, and simply inserting a small opening 30 in the diaphram 31 (see FIG. 1A). This small opening in the diaphram restricts the rate of pressure change in the section 63 in the same manner as did the restriction orfice 27.

Line 45 connects pressure switch 333 with the inlet manifold 9. When the vacuum in the manifold 9 decreases (pressure increases) below a valve of about 8.0 to 12.0 inches of mercury, the pressure switch 333 activates a red light 49 which is powered by the power source 59, and the green light 43 is deactivated. The pressure in the inlet manifold 9 will increase to such a pressure upon operating the engine on a power output which is too high for economical operation.

Line 69 connects pressure switch 334 with the inlet manifold 9. When the vacuum in the manifold 9 increases (pressure decreases) above a value of about 20.0 to 25.0 inches of mercury, the pressure switch 334 deactivates the green light 43. The pressure in the inlet manifold 9 will decrease to such a pressure upon operating the engine on a power output which is too low (idle conditions) for economical operation.

FIG. 1B shows an embodiment similar to that of FIG. 1A except that a piston 31C is used as the moveable partition. It contains a restrictive orifice 30A. Its movement extends to both sides as shown at 31A and 31B.

It should be noted that while the operator of an engine is intended to govern his driving actions in an attempt to operate with only the green light on, obviously the engine's operation may require at times rapid acceleration, deceleration or high power loading in certain emergency situations. Therefore the mechanism of this invention is only an aid to engine operation economy. The operation may at any time deviate from the mode of operation suggested by this invention in the interests of safety.

The scope of this invention is to be limited by the following claims:

What is claimed is:

1. In an internal combustion engine system comprising means for mixing air and a hydrocarbon fuel in combustible proportions, an internal combustion engine wherein said air-fuel mixture is burned thereby producing power, and an inlet manifold means connecting said air-fuel mixing means and said internal combutsion engine, said manifold thus allowing for the passage of said air-fuel mixture into said engine, the improvement which comprises: inlet manifold pressure sensing means comprising a chamber divided into two sections by a moveable partition, means connecting each section to said inlet manifold in pressure responsive relation, and restrictive orifice means in one of said connecting means delaying the pressure responsiveness of one of said sections thereby causing said partition to move responsive to a sudden inlet manifold pressure change of at least about 2 to 10 inches of mercury within not more than about 1 second.

2. The improved internal combustion engine system as claimed in claim 1 wherein said inlet manifold pressure change is further defined as at least about 2.0 to 5.0 inches of mercury occurring within not more than 1.0 seconds.

3. The improved internal combustion engine system as claimed in claim 1 wherein said moveable chamber partition is a piston.

4. The improved internal combustion engine system as claimed in claim 1 wherein said moveable chamber partiion is a diaphram.

5. The improved internal combustion engine system as claimed in claim 1 wherein said system further comprises a further engine operation indicative means responsive to an inlet manifold pressure of about 20.0 to 25.0 inches of mercury.

6. The improved internal combustion engine system as claimed in claim 1 wherein said system further comprises a further engine operative indicative means responsive to an inlet manifold pressure of about 8.0 to 12.0 inches of mercury.

7. The improved internal combustion engine system as claimed in claim 1 wherein said engine operation indicators are further defined as comprising three signal lights having different and distinct colors such as green, yellow and red, and means for activating said green light under normal engine operation conditions, activating said yellow light and deactivating said green and yellow lights responsive to an inlet manifold pressure of about 8.0 to 12.0 inches of mercury, and deactivating said green light responsive to an inlet manifold pressure of about 20.0 to 25.0 inches of mercury.

8. The improved internal combustion engine system as claimed in claim 4 wherein said restriction orfice is an orfice in said diaphram partitioning said first and second sections.

9. In a method of operating an internal combustion engine system comprising mixing air and a hydrocarbon fuel in combustible proportions; conveying said air-fuel mixture through an inlet manifold and thence into an internal combustion engine; and burning said air-fuel mixture in said engine, thereby producing power, the improvement which comprises: sensing said inlet manifold pressure, transmitting said inlet manifold pressure to a first section of a pressure sensing means chamber; transmitting said inlet manifold pressure through a restrictive orifice to a second section of said pressure sensing means chamber; coupling said sections by means of a pressure responsive moveable partition; moving said partition responsive to the different instantaneous pressure in each of said section caused by a sudden inlet manifiold pressure change of about 2 to 10 inches of mercury in not more than about 1 second; and activating a signal upon sensing said sudden inlet manifold pressure change.

10. the improved method of operating an internal combustion engine system as claimed in claim 9 wherein said inlet manifold pressure change is further defined as at least about 2.0 to 5.0 inches of mercury occurring within not more than 1.0 seconds.

11. The improved method of operating an internal combustion engine system as claimed in claim 9 wherein said moveable chamber partition is a piston.

12. The improved method of operating an internal combustion engine system as claimed in claim 9 wherein said moveable chamber partition is a diaphram.

13. The improved method of operating an internal combustion engine system as claimed in claim 9 wherein said method further comprises activating a signal upon sensing an inlet manifold pressure of about 20.0 to 25.0 inches of mercury.

14. The improved method of operating an internal combustion engine system as claimed in claim 9 wherein said method further comprises activating a signal upon sensing an inlet manifold pressure of about 8.0 to 12.0 inches of mercury.

15. The improved method of operating an internal combustion engine system as claimed in claim 9 wherein said signals are further defined as comprising three signal lights of different and distinctive colors such as green, yellow and red; activating said green light under normal engine operating conditions, activating said yellow light and deactivating said green light responsive to said sudden inlet manifold pressure change, activating said red light and deactivating said green and yellow light responsive to an inlet manifold pressure of about 8.0 to 12.0 inches of mercury, and deactivating said green light responsive to an inlet manifold pressure of about 20.0 to 25.0 inches of mercury.

16. The improved method of operating an internal combustion engine system as claimed in claim 12 wherein said restriction orfice is an orfice in said diaphram partitioning said first and second sections.

* * * * *